US005277255A

United States Patent [19]

Bell

[11] Patent Number: 5,277,255

[45] Date of Patent: Jan. 11, 1994

[54] WELL LINER RUNNING SHOE

[75] Inventor: John F. Bell, Longview, Tex.

[73] Assignee: Atlantic Richfield Company, Los Angeles, Calif.

[21] Appl. No.: 876,560

[22] Filed: Apr. 30, 1992

[51] Int. Cl.[5] ..... E21B 23/00; E21B 33/13

[52] U.S. Cl. ..... 166/290; 166/327

[58] Field of Search ..... 166/242, 285, 290, 327, 166/376, 381, 386

[56] References Cited

U.S. PATENT DOCUMENTS 2,169,569 8/1939 O'Donnell ..... 166/290

3,006,415 10/1961 Burns et al. ..... 166/327 X

FOREIGN PATENT DOCUMENTS 495488 8/1953 Canada ..... 166/290

*Primary Examiner*—David J. Bagnell

*Attorney, Agent, or Firm*—Michael F. Martin

[57] ABSTRACT

Wellbore liners are set with a running shoe comprising a cylindrical body, end cap, check valve and receiver member in assembly. The receiver member includes threads for receiving the coupling sleeve of a running tool, and retaining wickers for engagement with a cement plug or dart to retain the same permanently engaged with and blocking the flow of fluid through the running shoe. A running tool for use with the shoe includes a coupling sleeve which is retained on a support mandrel by a collar which is secured to the mandrel with a shear pin so that pressuring up the workstring, in the event of a stuck coupling sleeve, will permit retrieval of the main part of the running tool and the workstring. The interior parts of the running shoe are made of aluminum or plastic for easy drill-out to extend the wellbore beyond the end of the liner.

6 Claims, 1 Drawing Sheet

WELL LINER RUNNING SHOE

BACKGROUND OF THE INVENTION

1. Field of the Invention

The present invention pertains to a well liner running shoe which includes a check valve, cement plug receiver, and running tool receiver for operation with standard cement plugs and running tools. The running shoe is used to set well liners without requiring a liner hanger.

2. Background

In certain well operations, the wellbore is extended beyond the previous bottom or cased portion by inserting an extension of the casing or liner and hanging the liner off of the top end thereof by a hanger assembly which is engaged with the lower end of the casing previously extended into the wellbore. Such liner hangers are relatively expensive and, in relatively shallow wells which are, from time to time, extended deeper, the installation of a liner with a liner hanger is an expensive procedure. An alternate method involves extending the liner into the wellbore with a running tool and then cementing the liner in place by pumping cement through a shoe connected to the bottom of the liner. This arrangement is more economical and holds certain advantages, for setting liners on the bottom of a well, in particular.

However, there has been a need for providing certain improvements in liner running and setting using a running tool followed by a cementing procedure including the provision of a shoe which includes a check valve, a positive stop or separating member for running the cement into its final placement and while still having characteristics which will permit drilling out the shoe in the event that it is desired to extend the well even deeper.

The present invention provides certain improvements in apparatus and a method for setting well liners, particularly at the bottom of a well, without using a liner hanger but while employing a unique running shoe and setting method.

SUMMARY OF THE INVENTION

The present invention provides a unique well liner running shoe which includes ports for discharging cement into the well annulus between the liner and the wellbore wall, a check valve to prevent reverse flow of fluid up through the interior of the liner and the workstring, receiver means for receiving a cement plug or "dart" and receiver means for receiving a running tool which may be disconnected from the shoe after the liner has been set in its predetermined position.

The present invention also provides a unique well liner running shoe which is provided as a single assembly including a cap, a shoe body, a check valve closure member, support and seat member and a receiver member for receiving a cement plug and a workstring supported running tool.

In accordance with a further aspect of the present invention, a liner running shoe is provided which is easily drillable in the event that the wellbore is required to be extended further beyond the point of placement of the running shoe and the bottom of the liner to which the shoe is connected.

In accordance with another important aspect of the present invention, there is provided a modified liner running tool which is adapted to be disconnected from the running shoe even in the event of failure of the conventional disconnecting procedure and components.

In accordance with yet a further aspect of the present invention, an improved method is provided for setting a well liner using a bottom running shoe and running tool.

Those skilled in the art will further appreciate the above-mentioned aspects and advantages of the present invention together with other superior features thereof upon reading the detailed description which follows in conjunction with the drawing.

DESCRIPTION OF PREFERRED EMBODIMENTS

Figure 1:
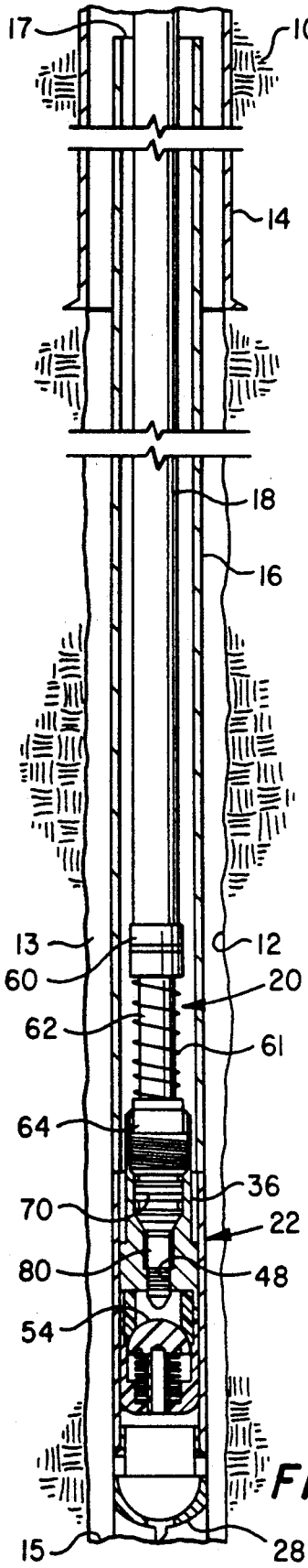
FIG. 1 is a vertical central section view of a well liner being run and set using the improved running shoe, running tool and method of the present invention.

In the description which follows, like parts are marked throughout the specification and drawing with the same reference numerals, respectively. The drawing figures are not necessarily to scale.

Referring to FIG. 1, there is illustrated a portion of an earth formation 10 into which an uncased wellbore portion 12 has been drilled and extended from a wellbore portion having a casing 14 extending therewithin. In many well operations it is desirable to extend the wellbore deeper by drilling beyond the cased wellbore portion and then inserting an additional casing section on the bottom 15 of the well using an elongated casing section or conduit sometimes referred to as a liner 16. In accordance with the present invention, the liner 16 is put in place in the wellbore portion 12 by extending the liner through the casing 14 from the surface, not shown, connected to the lower end of a drillstring or a "workstring", generally designated by the numeral 18. The workstring 18 is connected to the liner 16 by way of a liner running tool 20 which has been modified in accordance with the present invention and a unique liner running shoe, generally designated by the numeral 22 in FIG. 1. In the arrangement illustrated in FIG. 1, the liner 16 has been run to its set position by the tool 20 and the workstring 18, that is, with the shoe 22 resting on the bottom 15 of the wellbore portion 12. The running tool 20 is shown still connected to the shoe 22. The liner 16 may, of course, be set in its final position without actually contacting the bottom of the wellbore.

Figure 2:
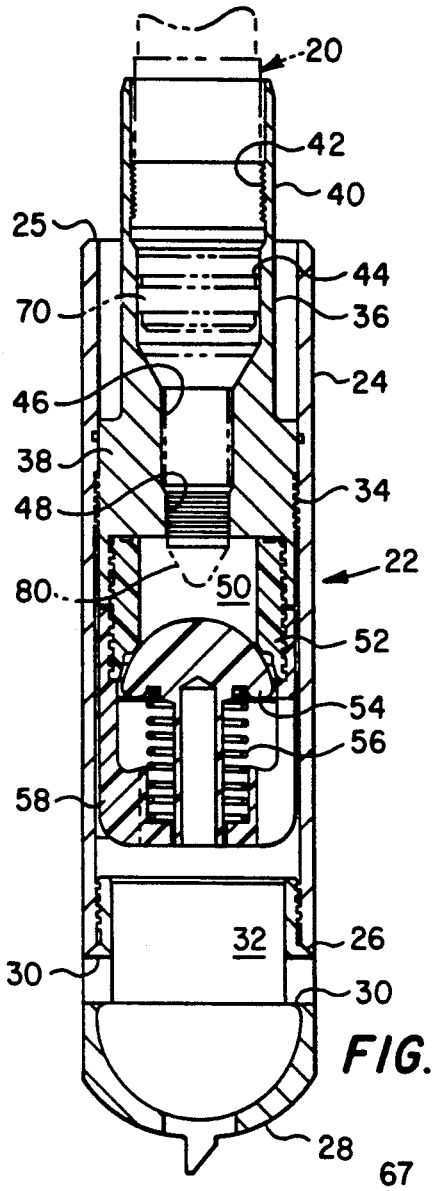
FIG. 2 is a longitudinal central section view of the running shoe of the present invention.

Referring also to FIG. 2, the running shoe 22 includes a generally cylindrical tubular body member 24 which is connected at its lower end 26 to a hollow hemispherical cap member 28. The cap 28 has one or more ports 30 formed therein which open from an interior space 32 to the exterior of the running shoe for conducting certain fluids such as cement into the annular space between the shoe and the wellbore wall for cementing the liner 16 in its final position, for example. The body 24 also includes an internally threaded portion 34 for threadedly receiving a receiver member 36. The receiver member 36 comprises a generally cylindrical body having a lower part 38 which is externally threaded to engage the threads 34 and is contiguous with a reduced diameter part 40 extending upward from the upper end 25 of the body 24. The receiver member 36 is also internally threaded at 42 for threadedly connecting the shoe 22 to the running tool 20. A seal bore 44 is formed in the receiver member 36 below the threads 42 and a further reduced diameter seal bore 46 is formed in the receiver member below the bore 44. Still further, the receiver member 36 is provided with suitable gripping means such as serrations or wickers 48 for receiving and engaging a cement plug to be described in further detail herein. The bore 46 opens into a cavity 50 formed by a valve seat member 52. The seat member 52 is engageable with a poppet type closure member 54 which is urged into engagement with the seat by spring means 56. The valve closure member 54 is slidably journalled by a support web 58 which is suitably connected to the seat member 52. The seat 52, in turn, is threadedly coupled to the tool receiver member 36. The shoe 22 is usually permanently connected to the lower end of the liner 16 such as by welding the liner to the upper end of the body 24 at the end face 25, for example. The body 24 may, of course, be otherwise coupled to the lower end of the liner 16 in other conventional ways.

The running shoe 22 is preferably fabricated of a relatively easily machinable metal, such as aluminum, particularly the cap 28 and the receiver member 36. The valve seat 52, closure member 54 and support web 58 are typically formed of a high-strength plastic which is also easily drillable or machinable. Accordingly, if, after permanently placing the liner 16 in the wellbore 12, it is desired to further extend the wellbore, the shoe 22 may be "drilled out" so that the wellbore may be extended below the shoe without removing the liner 16 from the wellbore.

Figure 3:
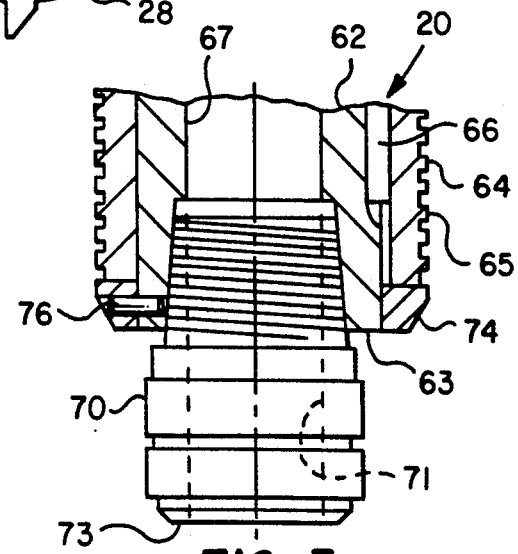
FIG. 3 is a detail section view of a modified running tool in accordance with the present invention.

Referring again to FIG. 1, the running tool 20 is of a generally conventional design including a coupling portion 60 for connecting the running tool to the workstring 18, a mandrel 62 and a threaded coupling sleeve 64 sleeved over the mandrel and axially biased toward the lower end of the mandrel by a suitable spring 61. The coupling sleeve 64 is axially slidable on the mandrel 62 but is non-rotatable relative thereto due to a key 66, FIG. 3, which is interfitted in suitable groove means formed in the mandrel 62 and in the coupling sleeve, as illustrated. The coupling sleeve 64 is provided with suitable threads 65 on the exterior thereof for engagement with the cooperating threads 42 on the receiver member 36. As shown in FIG. 3, the lower end of the running tool 20 is provided with a removable seal sub 70 which is adapted to engage the seal bore 44 and is threadedly connected to the lower end of the mandrel 62 as illustrated. FIG. 3 also illustrates a unique improvement in the running tool 20 wherein the coupling sleeve 64 is retained on the mandrel 62 at the lower end 63 of the mandrel by a collar 74 which is removable from the mandrel 62 but is secured thereto by frangible means comprising a shear pin 76 which is interfitted between the collar 74 and the mandrel 62. In the event that the coupling sleeve 64 cannot be disengaged from the receiver member 36 due to jammed or corroded threads or the like, the running tool 20 may still be disconnected from the shoe 22 by applying pressure fluid through the mandrel bore 67 and a bore 71 in the seal sub 70 so that pressure fluid may act against the lower end of the seal sub until a force is attained which will shear the pin 76 and allow the seal sub 70 and the mandrel 62 to be forced upward out of the receiver part 40.

Referring again to FIG. 1, as previously mentioned, the arrangement of the shoe 22, liner 16, workstring 18 and running tool 20 are shown in the positions they would be after running and setting the liner in place in the wellbore 12. In the configuration shown in FIG. 1, it is also assumed that cement, for example, has been pumped down through the workstring 18, the valve seat 52 and through the space 32 into the annular area 13 between the liner and the wellbore 12. Typically, cement is injected through the workstring 18 and the shoe 22 until the annular area 13 is filled up to the top end 17 of the liner, thereby also filling the annular space between the liner 16 and the casing 14. As the last of the cement is pumped into the workstring 18, a conventional dart type cement plug 80, FIG. 1, is pumped down through the workstring 18 and the running tool 20 to latch into the receiver member 36 at the wickers 48. Both the plug 80 and the tool 20 may, for example, be of a type manufactured by Baker-Hughes Company, Houston, Tex. The tool 20 has, of course, been modified in accordance with the present invention as described above and shown in FIG. 3. Thanks to the procedure wherein the plug 80 is set in place at the end of the cement injection process, the check valve 54 and the plug 80 both serve to prevent mixing of cement with other fluids which may be injected into the liner 16 through the workstring 18.

Setting the liner 16 in its final position will now be briefly described. After the wellbore 12 has been extended as indicated in FIG. 1, the liner 16 is connected to the shoe 22 by suitable means, such as welding the lower end of the liner to the end 25 of the body 24, and the tool 20 is connected to the running shoe receiver member 36 by threading the coupling sleeve 64 into the upper end 40 of the receiver member while the running shoe is, of course, connected to the workstring 18, preferably. The liner 16 is then run into the wellbore and set in the position shown in FIG. 1. Prior to disconnecting the workstring 18 and the tool 20 from the liner 16, the annular area 13 is cemented by injecting cement down through the workstring 18, the running tool 20 and the shoe 22 so that cement exits the ports 30 into the space 13 and fills the space up to at least the top 17 of the liner 16.

As the quantity of cement, which has been precalculated, is admitted into the workstring 18 the cement "slug" being pushed through the workstring is delimited at its upper end by the plug 80 which is inserted into the workstring in a conventional manner to define the upper end of the cement slug which is being pushed through the workstring. The plug 80 is pushed down through the workstring by suitable pressure fluid acting on the back side of the plug. As the plug 80 passes through the running tool 20 and enters the bore 46, the latching means on the plug engages the wickers 48 on the receiver member 36 to permanently latch the plug in position within the shoe. A small space remains open in the bore 44 above the plug 80 and below the lower end face 73 of the seal sub 70 so that, in the event that the running tool 20 cannot be disconnected from the shoe 22, the fluid pressure in the workstring 18 may be increased until a sufficient force is acting across the end face of the sub 70 to shear the frangible pin 76 and permit the sub 70, the mandrel 62 and the remainder of the tool 20, except for the coupling sleeve 64, to be removed from the liner 16.

Thanks to the check valve 54 and the cement plug 80, a redundant absolute seal is provided to prevent commingling the cement in the annular area 13 with other fluids which may be required to be conducted through the workstring 18 or into the liner 16 after removal of the workstring from the wellbore.

Thanks also to the configuration of the running shoe 22, a check valve is provided for preventing reverse flow of fluids into the liner interior, and means are also provided for receiving a plug to further seal the path of communication between the annulus 13 and the interior of the liner 16 or the workstring 18. Still further, receiver means are provided on the shoe 22 for receiving a running tool which may be removably coupled to the liner through the shoe 22. Still further, the running shoe 22 is provided of materials which may be easily drilled or machined away so that the wellbore may be extended down through the liner 16 and the body 24 of the running shoe.

Although a preferred embodiment of the present invention have been described in some detail herein, those skilled in the art will recognize that various substitutions and modifications may be made to the embodiment described without departing from the scope and spirit of the invention as recited in the appended claims.

What is claimed is:

1. In a running tool for running a wellbore liner and running shoe assembly into a wellbore wherein said running shoe includes a receiver member for receiving a coupling portion of said running tool, the improvement comprising:

an elongated mandrel;

a coupling sleeve disposed on said mandrel including means for connecting said running tool to a running shoe;

frangible means for retaining said coupling sleeve connected to said mandrel, said frangible means being responsive to pressure fluid acting on a transverse end face of said running tool for releasing said mandrel from said coupling sleeve whereby said mandrel and a workstring may be disconnected from said running shoe.

2. The running tool set forth in claim 1 wherein:

said coupling sleeve is retained on said mandrel by collar means and said collar means is connected to said mandrel by said frangible means.

3. For use with a wellbore liner to be set in a wellbore portion by a workstring and a running tool connected to said workstring, an improved running shoe adapted to be connected to said liner, said running shoe comprising:

an elongated, generally cylindrical outer body;

cap means disposed at one end of said body; and receiver means comprising an elongated receiver member having a first portion including means for threadedly coupling said receiver member to said body and a second portion including a first bore including means for receiving and engageable with cooperating coupling means on said running tool to secure said running tool to said running shoe and a second bore for receiving a cement plug to form a closure at one end of said liner to prevent a reverse flow of fluids into said liner.

4. The invention set forth in claim 3 including:

check valve means including means forming a seat, and a closure member supported in relation to said seat for movement to engage said seat to prevent the flow of fluid from said wellbore into and through said running shoe to a workstring.

5. The invention set forth in claim 4 wherein:

said means forming said seat is connected to said receiver member.

6. The invention set forth in claim 4 wherein:

said receiver member includes retaining means for retaining said plug in engagement with said receiver member to prevent the flow of fluid between said workstring and said wellbore.

* * * * *